US011027879B2

(12) United States Patent
Falvey

(10) Patent No.: US 11,027,879 B2
(45) Date of Patent: Jun. 8, 2021

(54) KEG CHIME

(71) Applicant: Petainer Large Container IP Limited, London (GB)

(72) Inventor: James Falvey, Bedfordshire (GB)

(73) Assignee: Petainer Large Container IP Limited, London (GB)

( * ) Notice: Subject to any disclaimer, the term of this patent is extended or adjusted under 35 U.S.C. 154(b) by 91 days.

(21) Appl. No.: 16/487,012

(22) PCT Filed: Feb. 27, 2018

(86) PCT No.: PCT/GB2018/050501
§ 371 (c)(1),
(2) Date: Aug. 19, 2019

(87) PCT Pub. No.: WO2018/154336
PCT Pub. Date: Aug. 30, 2018

(65) Prior Publication Data

US 2020/0231330 A1 Jul. 23, 2020

(30) Foreign Application Priority Data

Feb. 27, 2017 (GB) ..... 1703148

(51) Int. Cl.
*B65D 8/00* (2006.01)
*B65D 1/14* (2006.01)
(Continued)

(52) U.S. Cl.
CPC ..... *B65D 7/045* (2013.01); *B65D 1/14* (2013.01); *B65D 1/46* (2013.01); *B65D 11/06* (2013.01);
(Continued)

(58) Field of Classification Search
CPC ... B65D 1/46; B65D 1/14; B65D 1/12; B65D 7/045; B65D 7/04; B65D 11/06;
(Continued)

(56) References Cited

U.S. PATENT DOCUMENTS 2,049,977 A 8/1936 Ross et al.
2,087,349 A 7/1937 Lucker
(Continued)

FOREIGN PATENT DOCUMENTS

CA 2966212 5/2016
CN 1956892 5/2007
(Continued)

OTHER PUBLICATIONS

Great Britain Application No. GB1703148.5 Combined Search and Examination Report dated Jun. 23, 2017, 8 pages.
(Continued)

*Primary Examiner* — Robert J Hicks
(74) *Attorney, Agent, or Firm* — Kilpatrick Townsend & Stockton LLP

(57) ABSTRACT

The present invention relates to a keg chime configured to be mounted to a keg, for example a blow moulded plastic keg. The chime may include a handle that has a waveform profile when viewed in cross-section along a length of the handle. The handle may include a first set of one or more regions of inflection that provide a first surface of the handle and a second set of one or more regions of inflection that provide an opposing second surface of the handle. The chime may be configured to be connected to a sleeve for surrounding at least part of a body portion of the keg. The interface between the chime and the sleeve may be configured to permit axially outward movement of the chime with respect to the sleeve in order to accommodate axial expansion of the keg.

20 Claims, 10 Drawing Sheets

(51) Int. Cl.
*B65D 1/46* (2006.01)
*B65D 25/24* (2006.01)
*B65D 25/28* (2006.01)

(52) U.S. Cl.
CPC ..... *B65D 25/24* (2013.01); *B65D 25/28* (2013.01); *B65D 25/2826* (2013.01); *B65D 25/2888* (2013.01)

(58) Field of Classification Search
CPC ..... B65D 11/02; B65D 25/24; B65D 25/20; B65D 25/2802; B65D 25/28; B65D 25/2826; B65D 25/2888; B65D 25/2882
USPC ..... 220/729, 759, 755, 752, 634, 628, 649, 220/648, 646; 16/425, 422, 430
See application file for complete search history.

(56) References Cited

U.S. PATENT DOCUMENTS

| | | | |
|---|---|---|---|
| 4,294,374 | A | 10/1981 | Ames |
| 4,593,818 | A | 6/1986 | Schenkman |
| 6,662,963 | B1 | 12/2003 | Meike et al. |
| 2008/0203102 | A1 | 8/2008 | Wauters et al. |
| 2010/0072212 | A1 | 3/2010 | Howard et al. |
| 2010/0116836 | A1 | 5/2010 | Kolon |
| 2011/0180535 | A1 | 7/2011 | Apps |
| 2014/0251940 | A1 | 9/2014 | Wauters |
| 2016/0090215 | A1 | 3/2016 | Meinzinger |

FOREIGN PATENT DOCUMENTS

| | | |
|---|---|---|
| CN | 101641262 | 2/2010 |
| CN | 103797293 | 5/2014 |
| DE | 8528229 | 11/1985 |
| DE | 9320107 | 3/1994 |
| DE | 19723114 | 12/1998 |
| EP | 0661214 | 7/1995 |
| EP | 2172402 | 4/2010 |
| GB | 1127305 | 9/1968 |
| GB | 1537179 | 12/1978 |
| GB | 2001032 | 1/1979 |
| GB | 2446392 | 8/2008 |
| GB | 2446393 | 8/2008 |
| GB | 2452599 | 3/2009 |
| GB | 2481436 | 12/2011 |
| GB | 2481439 | 12/2011 |
| GB | 2490966 | 11/2012 |
| GB | 2532223 | 5/2016 |
| GB | 2541758 | 3/2017 |
| JP | 06345096 | 12/1994 |
| JP | H101141 | 1/1998 |
| JP | 2001010673 | 1/2001 |
| JP | 2003040276 | 2/2003 |
| WO | 2005113344 | 12/2005 |
| WO | 2008098935 | 8/2008 |
| WO | 2008098939 | 8/2008 |
| WO | 2011143724 | 11/2011 |
| WO | 2012174628 | 12/2012 |
| WO | 2016065486 | 5/2016 |

OTHER PUBLICATIONS

Great Britain Application No. GB1703148.5, Search Report for claims 23-40 dated Jul. 26, 2017, 2 pages.
International Application No. PCT/GB2018/050501, International Search Report and Written Opinion dated. Jul. 23, 2018, 17 pages.
GB1705592.2 , "Combined Search and Examination Report", dated Sep. 22, 2017, 8 pages.
GB1705592.2 , "Examination Report", dated Mar. 27, 2018, 6 pages.
GB1705592.2 , "Search Report", Claims Searched: 31-34, dated Mar. 22, 2018, 2 pages.
GB1705592.2 , "Search Report", Claims Searched: 16-22, and 23-24 in part, dated Mar. 27, 2018, 2 pages.
GB1705592.2 , "Search Report", Claims Searched: 25-29, dated Mar. 27, 2018, 2 pages.
GB1705593.0 , "Combined Search and Examination Report", dated Sep. 4, 2017, 7 pages.
GB1705593.0 , "Search Report", dated Oct. 11, 2018, 2 pages.
Application No. PCT/GB2018/050498 , International Search Report and Written Opinion, dated May 25, 2018, 13 pages.
Application No. PCT/GB2018/050499 , International Search Report and Written Opinion, PCT/GB2018/050499, International Search Report and Written Opinion, dated Jul. 23, 2018, 17 pages.
Chinese Application No. 201880014409.5, Office Action dated Oct. 10, 2020, with English Translation, 10 pages.

KEG CHIME

TECHNICAL FIELD

The present disclosure relates to a chime for a keg, and particularly, but not exclusively, to a handle of a chime for a plastic keg. Aspects of the invention relate to a chime, and to a keg assembly comprising a keg and at least one chime mounted to the keg.

BACKGROUND

Metal kegs are commonly used in the distribution and pressurised dispensing of beverages such as draught beer. Metal kegs typically include a main body that is configured to hold beverage and a neck portion extending outwardly from the top of the main body that receives a closure for connection to a filling head or dispense head. Such kegs typically further include a top chime extending above the top of the main body to protect the neck portion and the closure, and a bottom chime extending below the base of the main body to provide a stable base for the keg. The top and bottom chimes may be integrally formed with an outer wall of the main body of the keg, or alternatively formed as separate components that are attached to the main body of the keg. The top chime may be provided with handles to facilitate lifting of the keg, which may be formed by apertures extending through the outer wall of the top chime.

More recently, plastic kegs have also been used in the distribution and pressurised dispensing of beverages such as draught beer. Plastic kegs may, for example, be stretch blow mounded from a preform of PET. It is known to provide plastic kegs with a top chime and/or a bottom chime in order to provide protection to the top and/or bottom portions of the keg, as well as providing a stable base for the keg. As with the top chimes of traditional metal kegs, the top chime of a plastic keg may be provided with handles to facilitate lifting of the keg, for example as described in GB2490966.

However, existing chime handles can be uncomfortable for manual gripping, and may reduce the strength and stiffness of a chime and/or make inefficient use of material.

In addition, plastic keg assemblies may be provided with an outer sleeve for protecting a body portion of the keg. The sleeve may extend between and be connected to top and bottom chimes. However, known plastic keg assemblies including a sleeve extending between top and bottom chimes cannot take account of in-use variations in the length of the keg, for example as a result of increased internal pressure.

It is an aim of the present invention to address disadvantages associated with the prior art.

SUMMARY OF THE INVENTION

According to a first aspect of the present invention there is provided a chime configured to be mounted to a keg, the chime comprising a handle. The handle may have a waveform profile when viewed in cross-section along a length direction of the handle. The handle may define at least one region of inflection forming at least part of a first surface of the handle, and at least one further region of inflection forming at least part of a second surface of the handle.

It will be appreciated that a chime is a device that is configured to be mounted to a beverage keg in order to provide protection to a top or bottom portion of the keg and/or to provide a convenient point by which the keg may be gripped in use. It will further be appreciated that a view in cross-section along a length direction of the handle means a view looking along a length direction or axis of the handle, for example a view from a plane that is perpendicular to the length direction or axis of the handle.

It will further be appreciated that a waveform profile is defined by a shape that alternates between one or more regions of inflection on a first side of the waveform profile, for example one or more "peaks", and one or more regions of inflection on a second side of the waveform profile, for example one or more "troughs". (The terms "peaks" and "troughs" are not limited by orientation, and so the "peaks" and "troughs" may be in any relative orientation when the handle is in its normal orientation for use.) Therefore the waveform profile of the handle is not required to follow a conventional curved sine wave shape, but may instead have a stepped or otherwise angular waveform shape. Each region of inflection may have a generally U shaped profile, which may be continuously curved, curved with a flat central portion, or angular with a curved or flat central portion. The regions of inflection may extend along the length direction of the handle, and optionally along at least substantially the entire length of the handle.

The handle provides a convenient lifting point by which a keg to which the chime may be mounted in use may be lifted. The handle may also be configured to be gripped by keg handling apparatus, for example in a keg filling line.

The waveform profile of the handle provides a simple, robust, stiff and lightweight handle that is convenient and comfortable for manual handling. In particular the waveform profile provides high strength and avoids a major outer surface of the handle being formed by an end face of a wall, as is the case with handles that are formed by an aperture extending through a wall and handles having a simple U-shaped construction. The inherent strength of the waveform profile also allows a reduction in the quantity of material required for the handle, thereby reducing the cost and weight of the chime. The regions of inflection may provide the outer-most contact surfaces of the handle.

The first surface of the handle may be opposed to the second surface of the handle. The first surface may be a bottom surface of the handle and the second surface may be a top surface of the handle when the chime is in its normal orientation for use, for example when mounted to a keg that is standing in an upright orientation with its opening at the top. Alternatively the first and second surfaces may define radially inner and radially outer surfaces of the handle with respect to a longitudinal axis of the chime, especially where the chime is optimised for horizontal chest carrying of a keg. Other orientations are also possible.

At least one of the first and second surfaces of the handle may be convexly curved when the handle is viewed in cross-section along its length direction. The convex curvature may be provided by curvature of the regions of inflection providing the first and second surfaces and/or by the relative positions and/or angles of the regions of inflection providing the first and second surfaces.

The waveform profile of the handle may define a plurality of regions of inflection that together form at least part of the first surface of the handle, for example the bottom surface of the handle. According to one preferred example the handle may include three regions of inflection that together form the first surface of the handle, although in other embodiments the first surface of the handle may be formed by a greater or smaller number of regions of inflection, including by a single region of inflection. The region(s) of inflection that form the first surface of the handle may be regarded as a first set of regions of inflection.

The waveform profile of the handle may define a plurality of regions of inflection that together form at least part of the second surface of the handle, for example the top surface of the handle. According to one preferred example the handle may include two regions of inflection that together form the second surface of the handle, although in other embodiments the second surface of the handle may be formed by a greater or smaller number of regions of inflection, including by a single region of inflection. The region(s) of inflection that form the second surface of the handle may be regarded as a second set of regions of inflection.

The handle may comprise one or more walls forming a body of the handle. The wall(s) may extend along the length direction of the handle, and optionally along at least substantially the entire length of the handle. The wall(s) may be integrally formed with the regions of inflection. The wall(s) may be radially spaced apart from each other with respect to a central longitudinal axis of the chime.

For example, the handle may comprise at least one connecting wall that extends between and connects a region of inflection forming at least part of the first surface of the handle and a region of inflection forming at least part of the second surface of the handle. The connecting wall(s) may extend in an at least substantially vertical direction when the chime is in its normal orientation for use (for example when mounted to a keg that is standing in an upright orientation), and may extend in a substantially straight line when viewed in cross-section along the length direction of the handle. Where a plurality of the connecting walls are present, the connecting walls may be at least substantially parallel to each other. In some cases the walls may be slightly angled with respect to each other in order to facilitate removal form a mould.

The handle may further comprise at least one outer wall that extends outwardly from one of the regions of inflection to define an outer edge of the handle. The outer wall(s) may define side edges of the handle extending between the first and second surfaces of the handle, for example a radially inner side edge and a radially outer side edge with respect to the chime. The outer wall(s) may have curved outer surfaces.

The handle may comprise at least one reinforcing web that extends between and connects an adjacent pair of the walls. For example, the handle may comprise at least one reinforcing web that extends between and connects a pair of adjacent connecting walls and/or at least one reinforcing web that extends between and connects a connecting wall to an adjacent outer wall. The reinforcing webs may be integrally formed with the walls.

At least one of the regions of inflection may comprise a substantially planar central portion. Providing at least one of the regions of inflection with a substantially planar central portion may result in a handle that is more comfortable for gripping in a user's hand.

The central portion may be joined to a pair of walls of the handle via curved transition portions extending along the edges of the central portion. Joining the central portion to a pair of walls via curved transitions portions may result in a handle that is more comfortable for gripping in a user's hand, and may minimise stress concentrations.

At least one of the regions of inflection may have a continuously curved shape, that is a shape without any planar portions or sharp corners. Forming at least one of the regions of inflection with a continuously curved shape may result in a handle that is more comfortable for gripping in a user's hand, and may minimise stress concentrations.

The waveform profile of the handle may be defined by a continuous handle element that forms the regions of inflection and the walls of the handle.

The waveform profile of the handle may generally take the form of a sine wave. The waveform profile may be continuously curved, and may optionally take the form of a true sine wave. Alternatively the waveform profile may include one or more substantially straight sections, for example in the regions of inflection and/or the walls connecting the opposed regions of inflection. Alternatively the waveform profile may have a stepped shape, and may be generally angular.

The handle may have a cross-sectional profile that is at least substantially constant along at least a majority of the length of the handle. It will be appreciated that some variations in the cross-sectional profile may be present, for example due to the presence of one or more reinforcing webs.

The handle may have a generally circular outer shape when viewed in cross-section along its length direction.

The handle may comprise at least one drainage aperture that is configured to allow fluid inside the handle to drain to the exterior of the handle. In some cases each region of the handle that might collect fluid when the chime is in its normal orientation for use may be provided with at least one drainage aperture. The drainage apertures may, for example, be provided in the regions of inflection.

The handle may extend between a pair of arms via which the handle is connected to a body portion of the chime. The handle may be integrally formed with the arms, which may be integrally formed with the body portion. The body portion of the chime may be a portion of the chime via which the chime is configured to be mounted to a keg, for example by direct attachment to a portion of the keg and/or by attachment to a sleeve extending between top and bottom chimes at opposed axial ends of the keg. The arms may extend in a generally vertical direction when the chime is in its normal orientation for use.

The handle may have a curved shape along its length direction, as opposed to extending in a straight line along its length axis. The handle may have a centre of curvature that is coincident with a central longitudinal axis of the chime. A curved handle shape may result in improved handling comfort, increased handle rigidity, and allow the most efficient use of material in the handle.

The handle may form part of an outer crown portion of the chime. In this case the strength and rigidity of the handle may contribute to the overall strength and rigidity of the crown portion. The crown portion of the chime may be configured to extend above the upper-most point of a keg to which the chime may be mounted (and optionally above the upper-most point of a closure fitted to the keg) in the case of a top chime, or to extend below the lower-most point of a keg to which the chime may be mounted in the case of a bottom chime. The crown portion may be configured to be the axially outer most portion of the chime, for example with respect to a keg to which the chime may be mounted in use. The crown portion may be configured to provide protection to a top portion or a bottom portion of a keg to which the chime may be mounted in use and/or to provide a convenient point by which the keg may be lifted. The crown portion of the chime may extend continuously around the chime, and may be continuously curved around its circumference, for example in a circular shape. The crown portion may have a centre of curvature that is coincident with a central longitudinal axis of the chime.

The chime may be a top chime (that is a chime configured to be located adjacent to a top portion of a keg). The top chime may be configured to protect the top portion of the keg and a closure fitted to the keg, and/or to provide a convenient point by which the keg may be lifted in use. In the case of a top chime, the chime is preferably configured to allow a filling head or dispense head to be coupled to a closure fitted to a neck portion of a keg while the chime remains mounted to the keg. Alternatively the chime may be a bottom chime (that is a chime configured to be located adjacent to a base of a keg). In this case the bottom chime may be configured to protect a base of the keg and/or to provide a flat, stable base on which the keg may stand in use.

The chime may comprise a plurality of the handles, each of which may include any of the features described above in relation to the first handle. The handles may be spaced apart around the chime.

The chime may have a generally single piece construction, and may be configured to be press fitted or screwed in an axial direction onto a top or bottom end of a keg. In some cases the chime may be provided with a separate retaining element for clamping the chime to a neck portion of the keg. Alternatively the chime may have a multi-piece construction, for example being formed by a pair of opposed jaws that are configured to be clamped around a top or bottom end of a keg, in which case each of the jaws may include at least one handle as described above.

The handle may be formed of a plastics material. For example, the handle (and optionally the entire chime) may be formed of HDPE, and may be injection moulded.

According to a further aspect of the present invention there is provided a keg assembly comprising a keg and at least one chime according to the first aspect of the present invention mounted to the keg.

The keg may be a plastic keg, for example a PET keg, and may be blow moulded from a preform. The keg may be configured to independently withstand internal pressurisation forces in use without requiring any external support structure during transportation of the keg and/or pressured dispensing operations. The keg may, for example, be designed to operate at an internal pressure of at least 0.5 bar (gauge pressure) in the case of a wine keg for use in the distribution and pressurised dispensing of wine, or at an internal pressure of at least 2 bar (gauge pressure) in the case of a beer keg for use in the distribution and pressurised dispensing of draught beer. The keg may be configured to independently withstand an internal pressure of at least 5 bar (gauge pressure). The keg may be generally cylindrical, and may have a circular cross-section. The keg may have a capacity of at least 10 litres or at least 20 litres.

The keg assembly may comprise a first chime or top chime mounted adjacent to a top portion of the keg and a second chime or bottom chime mounted adjacent to a base of the keg, either or both of which may be chimes according to the first aspect of the present invention. One or both of the top and bottom chimes may be attached directly to the keg. Alternatively, or in addition, the top and bottom chimes may be attached to opposite ends of a sleeve that surrounds a body portion of the keg and extends between the top and bottom chimes.

According to a further aspect of the present invention there is provided a keg protection system comprising a sleeve and a chime configured to be connected to the sleeve. The sleeve may be configured to surround at least part of a body portion of the keg, and may be configured to protect and/or provide reinforcement to the body portion of the keg.

The chime may be configured to be connected to the sleeve by at least one coupling. The coupling may comprise an engagement element and an aperture configured to receive the engagement element to thereby couple the chime to the sleeve. The engagement element may be provided on the chime and the aperture may be provided in the sleeve. The aperture may be located adjacent to an axial end of the sleeve. It will be appreciated that the chime may comprise a plurality of the engagement elements, and that the sleeve may comprise a corresponding plurality of the apertures.

The coupling may be configured to allow the chime to move away from an initial position with respect to the sleeve in an axially outward direction while the chime remains coupled to the sleeve. By allowing the chime to move away from the initial position in an axially outward direction with respect to the sleeve, the keg protection system is able to accommodate an increase in the length of a keg to which the keg protection system may be mounted in use, for example as a result of increased internal pressure due to high temperatures, vibrations or impacts. It may therefore be possible to accommodate in-use variations in the length of the keg without including a large amount of slack in the initial configuration of the keg protection system.

The coupling may be configured to retain the chime in the initial position with respect to the sleeve. By positively retaining the chime in the initial position accidental or unwanted movement of the chime away from the initial position may be prevented.

The coupling may be configured to retain the engagement element in a first position with respect to the aperture to thereby retain the chime in the initial position, and to allow the engagement element to move out of the first position to thereby permit movement of the chime away from the initial position in the axially outward direction.

The chime may be configured to be moved away from the initial position in the axially outward direction in response to a force being applied to the chime in the axially outward direction, for example by a keg mounted within the keg protection system. The coupling may be configured to retain the chime in the initial position until a force is applied to the chime that is sufficiently great to move the engagement element out of its first position, for example by deforming the aperture.

The aperture may define at least two axially-spaced detent positions for the engagement element. The detent positions may include a first detent position corresponding to the initial position of the chime, and a second detent position corresponding to a second position of the chime axially outboard of the initial position.

The aperture may comprise a slot, wherein the engagement element is movable along the slot in order to permit movement of the chime away from the initial position in the axially outward direction.

The aperture may be configured to be deformed by the engagement element in order to permit movement of the chime away from the initial position in the axially outward direction.

The aperture may comprise a body portion that is configured to receive the engagement element when the chime is in the initial position with respect to the sleeve, and an expansion region into which the engagement element is movable in order to permit movement of the chime away from the initial position in the axially outward direction.

The expansion region may be formed continuously with the body portion of the aperture, for example as part of a single continuous opening. Alternatively the expansion region may be separated from the body portion of the aperture by a wall. In this case the wall may comprise a pre-weakened region, and may be configured to be ruptured by the engagement element in order to permit movement of the engagement element into the expansion region.

The expansion region may extend away from the body portion of the aperture in a direction towards an axial end of the sleeve.

The expansion region may be configured to retain the chime in a second position axially outboard of the initial position.

The body portion of the aperture may have a width or diameter that is similar to a width or diameter of the engagement element. The body portion of the aperture may have a shape that at least substantially corresponds to the shape of the engagement element. The body portion of the aperture and/or the engagement element may, for example, have a circular shape, although other shapes are also possible.

The expansion region of the aperture may have a width that is smaller than a width or diameter of the body portion of the aperture and/or smaller than a width or diameter of the engagement element. Where the expansion region has a width that is smaller than a width or diameter of the engagement element the expansion region must be deformed by the engagement element in order for the engagement element to enter the expansion region.

The expansion region may be generally elongate and may take the form of a slot. In some cases the expansion region may comprise a very thin slot, for example in the form of a simple slit or cut. However, in other embodiments the slot may have a larger width.

The engagement element may comprise a stud or pin, optionally a split stud or pin.

The engagement element may be pivotally connected to the chime. For example, the engagement element may be provided on a flap that is pivotally connected to the chime by a living hinge, in which case the flap may be configured to be manually depressed in order to introduce the engagement element into the aperture to thereby couple the chime to the sleeve. Alternatively then engagement element may be configured to automatically enter the aperture when the chime is press fitted onto the sleeve.

The engagement element may be provided in an outer wall portion of the chime that is configured to surround an axial end of the sleeve when the chime has been coupled to the sleeve.

The chime may comprise an annular groove that is configured to receive an axial end of the sleeve when the chime has been coupled to the sleeve.

The chime may be a top chime configured to be located adjacent to a top portion of the keg. Alternatively the chime may be a bottom chime configured to be located adjacent to a bottom portion of the keg. In some cases the keg protection system may include a top chime and a bottom chime, in which case either one or both of the top and bottom chimes may be configured to interact with the sleeve in the manner described above. In other cases the keg protection system may include a top chime only, in which case the sleeve may include a base that is configured to extend underneath a base of the keg when the keg protection system has been mounted to the keg.

According to a further aspect of the present invention there is provided a keg assembly comprising a keg and a keg protection system as described above mounted to the keg. The keg may be a keg as described above.

Within the scope of this application it is expressly intended that the various aspects, embodiments, examples and alternatives set out in the preceding paragraphs, in the claims and/or in the following description and drawings, and in particular the individual features thereof, may be taken independently or in any combination. That is, all embodiments and/or features of any embodiment can be combined in any way and/or combination, unless such features are incompatible. The applicant reserves the right to change any originally filed claim or file any new claim accordingly, including the right to amend any originally filed claim to depend from and/or incorporate any feature of any other claim although not originally claimed in that manner.

BRIEF DESCRIPTION OF THE DRAWINGS

One or more embodiments of the invention will now be described, by way of example only, with reference to the accompanying drawings, in which.

DETAILED DESCRIPTION

Figure 1:
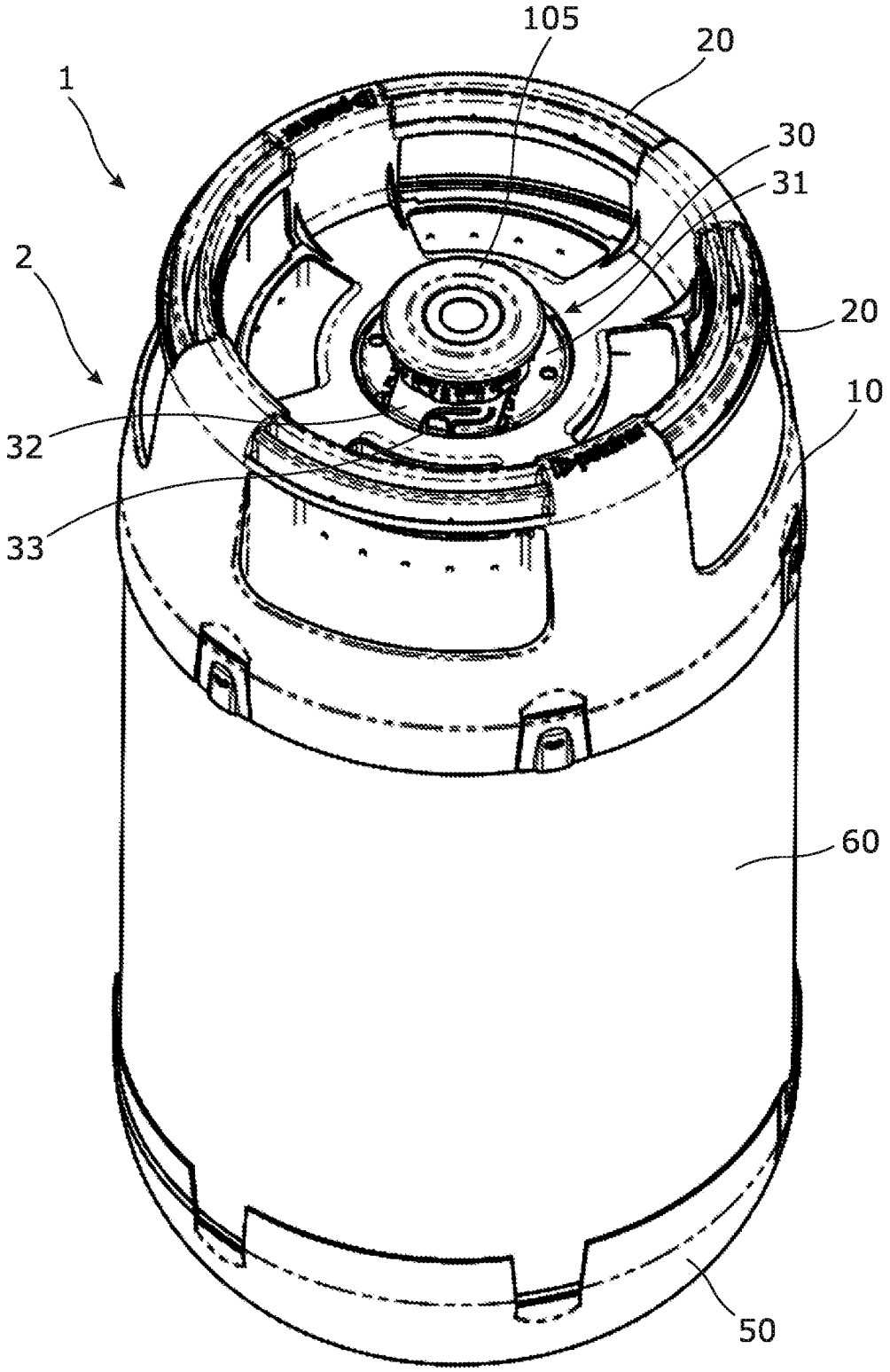
FIG. 1 illustrates a keg assembly.

FIG. 1 illustrates a keg assembly 1 including a beverage keg 100 and a keg protection assembly 2 for protecting the keg 100. The keg protection assembly 2 comprises a top chime 10 in accordance with an embodiment of the present invention that protects a top portion of the keg 100, and a bottom chime 50 that protects a bottom portion of the keg 100 and provides a stable base for the keg assembly 1. The keg protection assembly 2 further comprises a sleeve 60 that extends between and is connected to the top and bottom chimes 10, 50, and that protects a body portion of the keg 100.

Figure 2A:
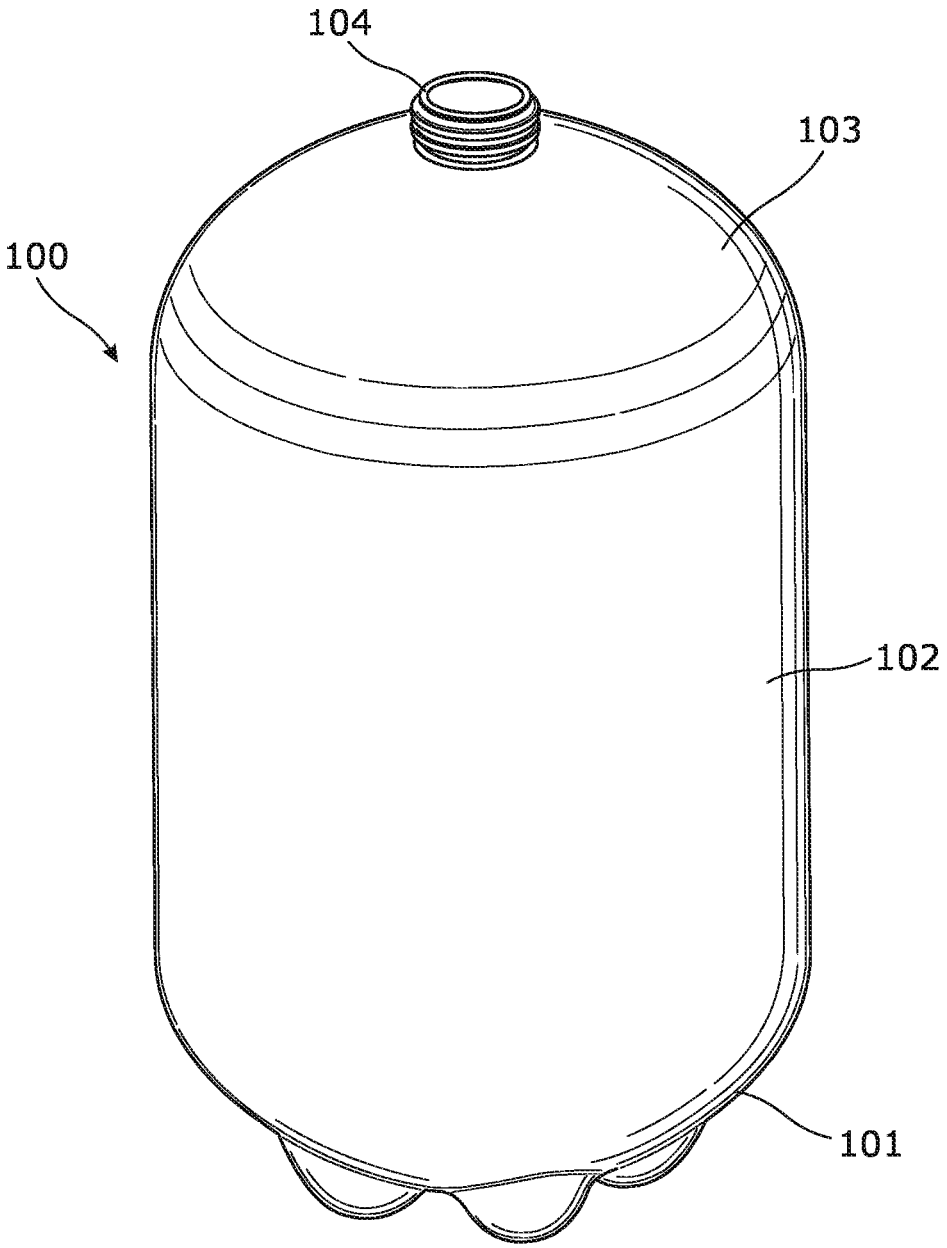
FIGS. 2*a* and 2*b* illustrate a keg and a cross-section view through a top portion of the keg.

The keg 100 is illustrated in isolation in FIG. 2*a*. In the present embodiment the keg 100 is a plastic keg that has been stretch blow moulded from a preform of PET. The keg 100 has a substantially hemispherical base portion 101 including a plurality of blister like feet arranged in a petaloid formation on which the keg 100 may stand in use (although in the present embodiment the keg 100 is housed within the keg protection assembly 2 which provides a separate base on which the keg assembly 1 may stand in use). The keg 100 further comprises a cylindrical body portion 102 with a circular cross-section that is integrally formed with and extends upwardly from the top of the base portion 101, and a substantially hemispherical shoulder portion 103 that is integrally formed with the body portion 102 at the top edge thereof.

Figure 2B:
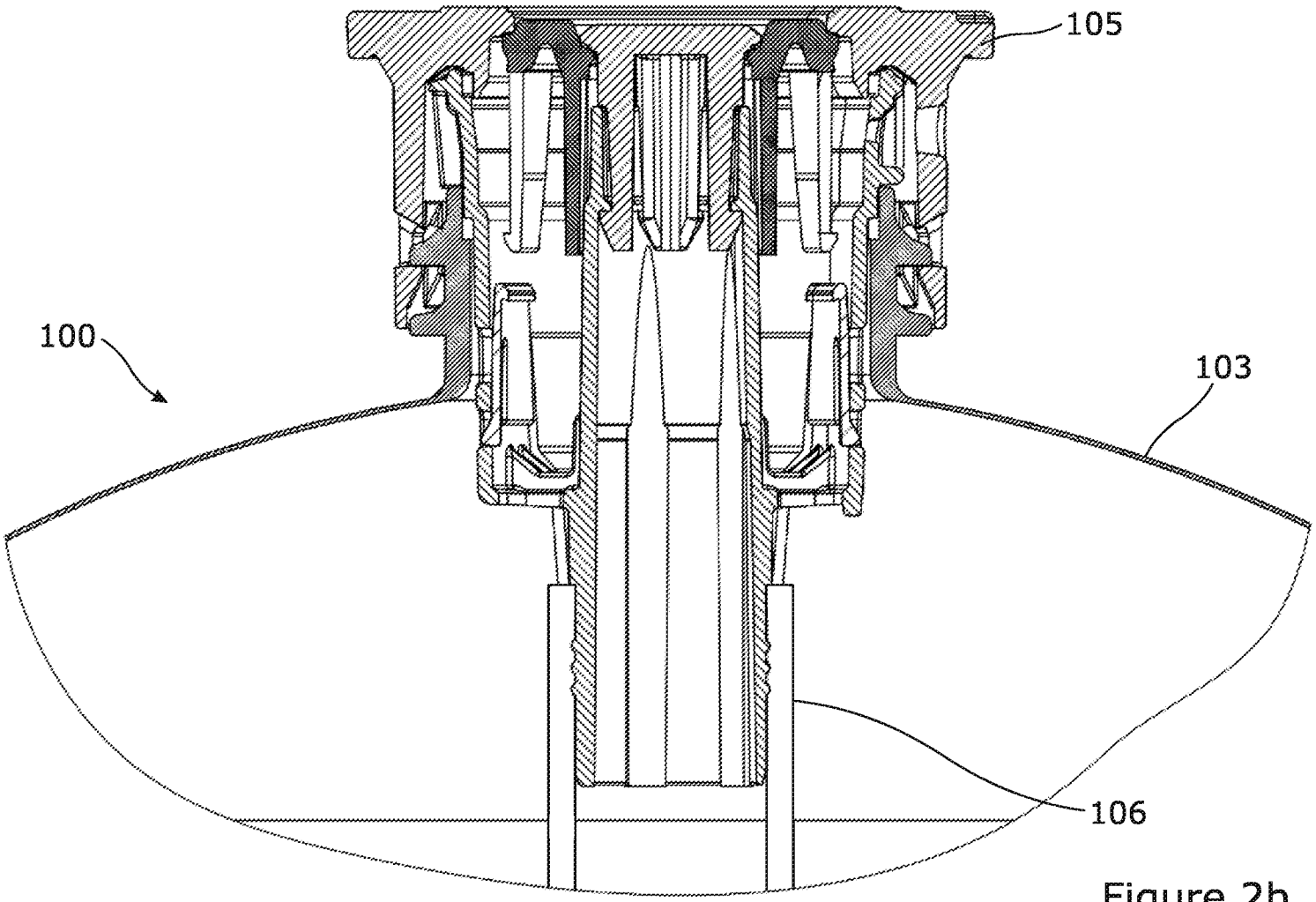

At the top of the shoulder portion 103 the keg 100 is provided with a neck portion 104 that defines an opening of the keg 100. A closure 105, illustrated in FIG. 2*b*, is fitted to the neck portion 104 of the keg 100, for example by a snap fit engagement with an upper annular ring provided around the neck portion 104. The closure 105 defines a pair of concentric flow paths into and out of the keg 100 that may be selectively opened and closed by a valve arrangement.

The closure 105 is provided with a dip-tube or spear 106 that is in communication with the inner flow path and extends to a location near to the bottom of the keg 100. The closure 105 is configured to be coupled to a filling head to enable the keg 100 to be filled with beverage via the outer flow path, and to be coupled to a dispense head to enable beverage to be dispensed from the keg 100 under pressure via the spear 106 and the inner flow path.

The keg 100 has a capacity of approximately 30 litres, and is configured to be used in the distribution and pressurised dispensing of draught beer. In the present embodiment the keg 100 is configured to be able to independently withstand the pressures associated with pressurised dispensing of draught beer, for example at an operating pressure of approximately 2 bar (gauge pressure), although additional protection and reinforcement is provided to the keg by the keg protection assembly 2.

The various components of the keg protection assembly 2 will now be described. It will be appreciated that all references to directions made throughout this specification, such as ""top", "bottom", "upper", "lower", "upwardly", "downwardly", "vertical" and "horizontal" are made with respect to a keg assembly in upright orientation as illustrated in FIG. 1. It will further be appreciated that the orientations of each part of the keg assembly may vary in use, for example if the keg assembly is stored or used in an orientation different to that illustrated in FIG. 1.

Figure 3A:
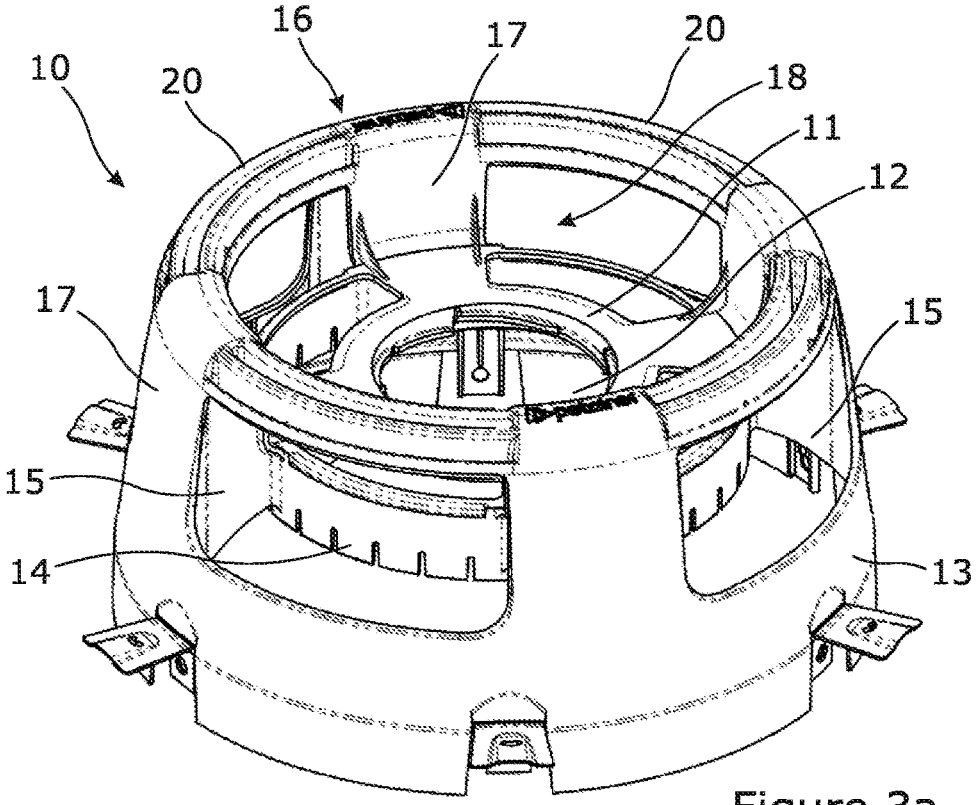
FIGS. 3*a* and 3*b* illustrate a top chime from the keg assembly illustrated in FIG. 1.
Figure 3B:
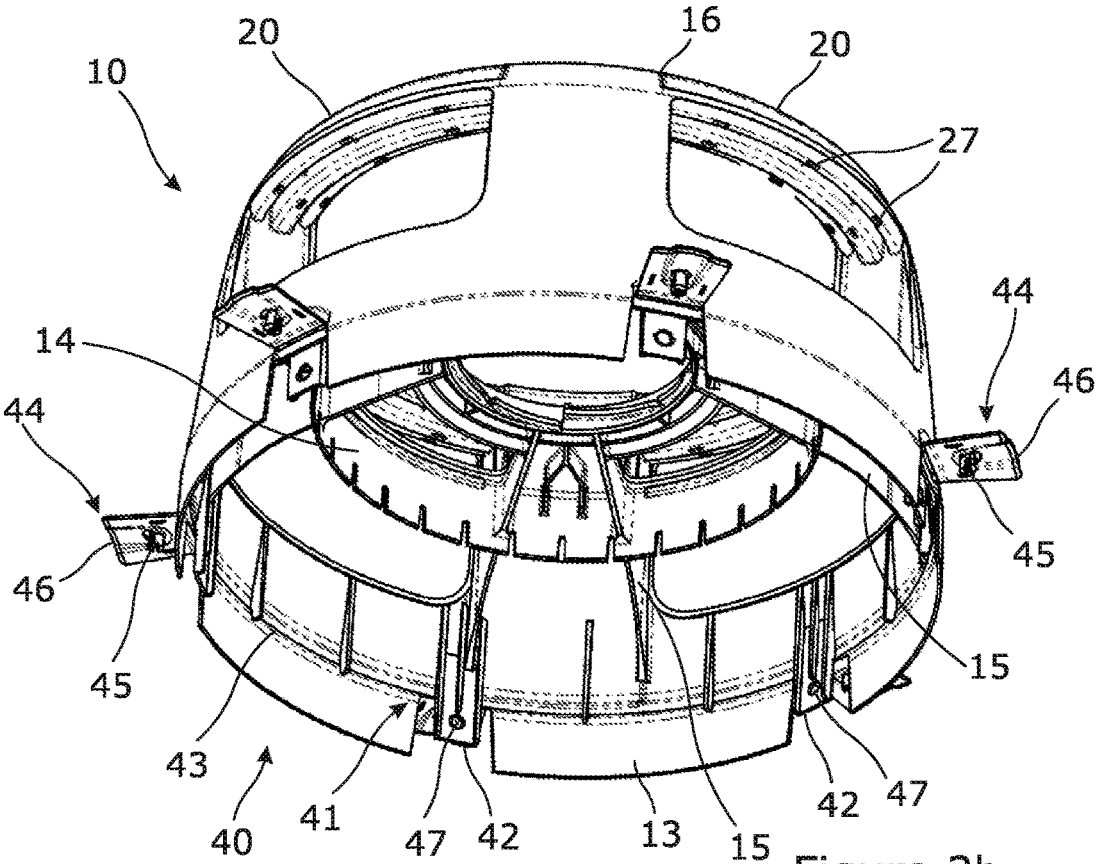
Figure 4A:
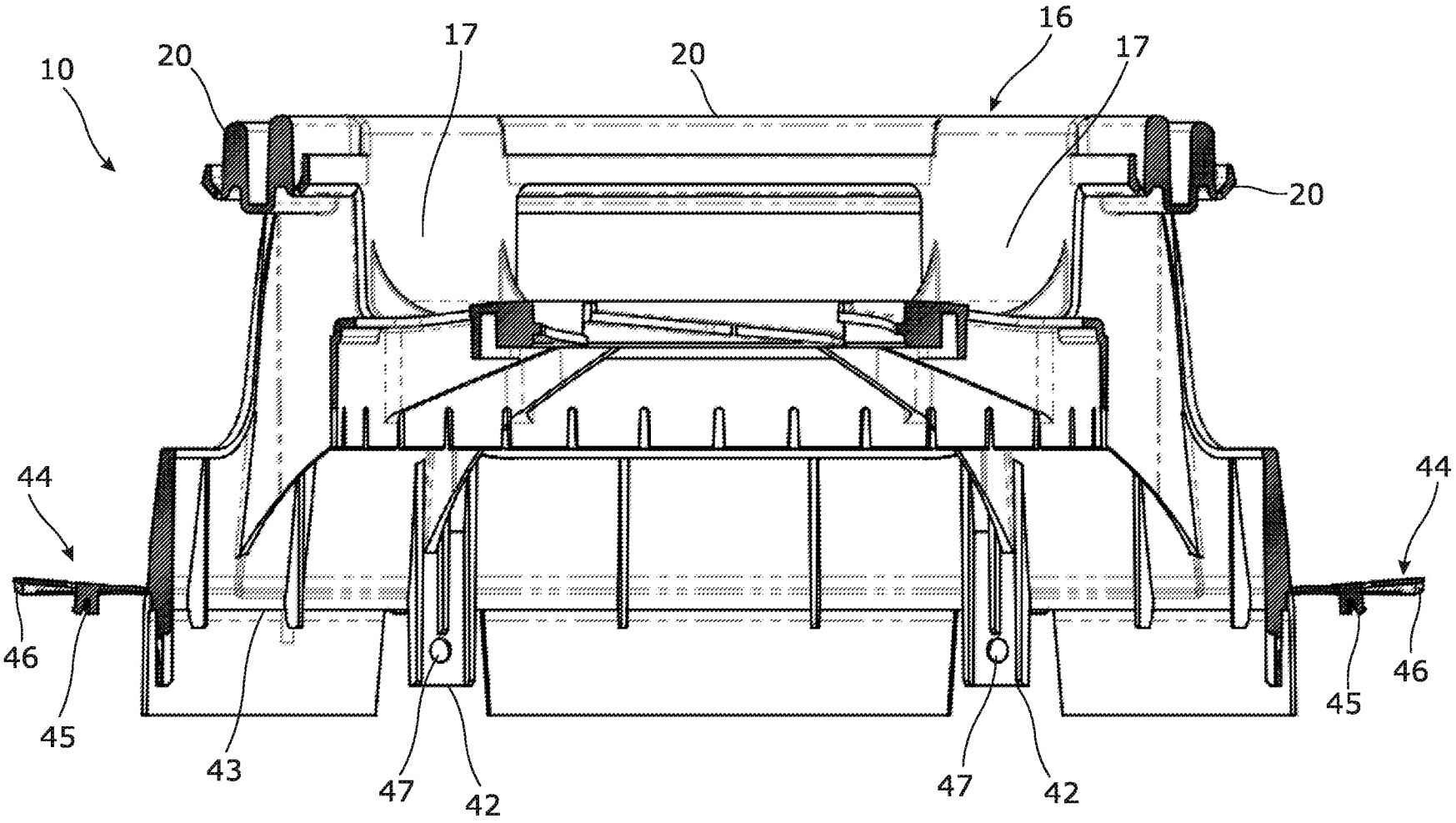
FIGS. 4*a*, 4*b*, 5*a* and 5*b* illustrate cross-section views through the top chime.
Figure 4B:
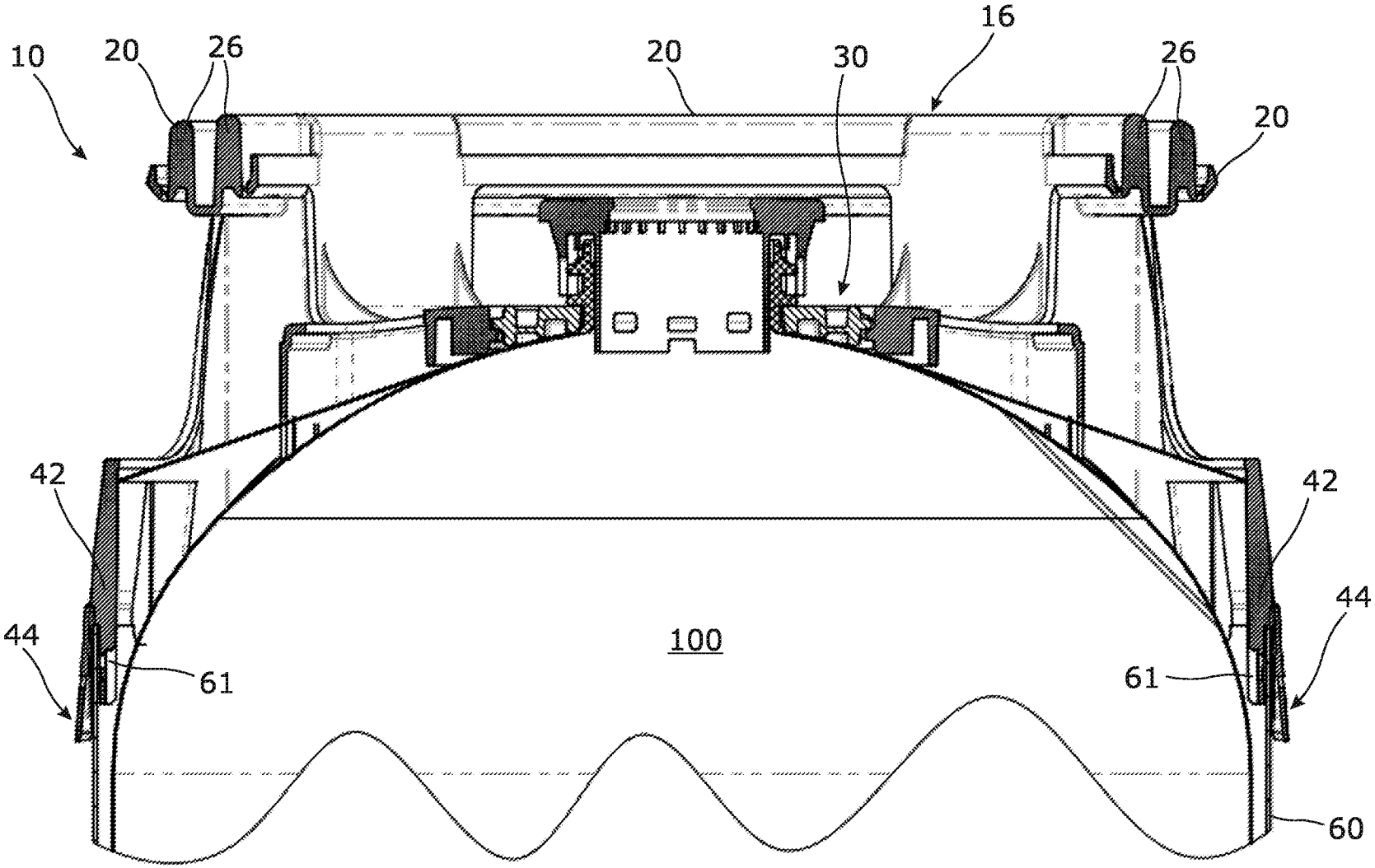

As illustrated in FIGS. 3*a* and 3*b*, the top chime 10 comprises a central portion or body portion 11 in the form of a generally annular, slightly domed wall. The body portion 11 defines a central aperture 12 that is configured to surround the neck portion 104 of the keg 100 when the top chime 10 has been assembled together with the keg 100. The body portion 11 includes a continuous inner part that extends continuously around the central aperture 12, and an outer part that includes a plurality of apertures. The top chime 10 further comprises an annular outer wall 13 that surrounds the body portion 11. The outer wall 13 extends below the body portion 11 and together with the body portion 11 defines a concave socket within which the shoulder portion 103 of the keg 100 is received when the top chime 10 has been assembled together with the keg 100, as illustrated in FIGS. 4*b* and 5*b*.

The body portion 11 is provided with an annular wall 14 which extends downwardly from an outer edge of the continuous inner part of the body portion 11 at a location inboard of the outer wall 13, the lower edge of which is configured to engage the shoulder portion 103 of the keg 100. The top chime 10 further comprises a plurality of ribs 15 that extend downwardly from the body portion 11. The ribs 15 extend radially outwardly with respect to the central longitudinal axis of the top chime 10 and connect the body portion 11 to the outer wall 13. The ribs 15 have a profile that compliments the shape of the shoulder portion 103 of the keg 100.

The top chime 10 further comprises a crown portion 16 that is arranged above the body portion 11 and the outer wall 13. The crown portion 16 forms the upper-most part of the top chime 10 when the top chime 10 is in its normal orientation for use, and extends above the upper-most point of the keg 10 and the closure 105 when the top chime 10 has been assembled together with the keg 100. The crown portion 16 extends continuously around the top chime 10 and has a generally circular shape that is concentrically arranged with respect to the longitudinal axis of the top chime 10.

The crown portion 16 has an outside diameter that is slightly smaller than the outside diameter of the outer wall 13, and defines a recess 18 at the top of the keg assembly 1, with a base of the recess being formed by the body portion 11 of the top chime 10. The upper part of the neck portion 103 of the keg 100 and the closure 105 protrude into the recess through the central aperture 12 and are therefore protected within the recess by the crown portion 16. The recess defined by the crown portion 16 is significantly wider than the outside diameter of the neck portion 103 of the keg 100 and the closure 105 (for example by at least 100 mm) and the crown portion 16 extends a significant distance above the top of the closure (for example by at least 10 mm) in order to allow easy access to the closure while also providing effective protection. The top chime 10 is designed such that it is possible to connect the closure 105 to a standard filling head or dispense head (for example a standard Type A filling head or dispense head commonly used in combination with beer kegs) in order to fill the keg 100 or dispense beverage from the keg 100 while the top chime 10 remains mounted to the keg 100.

The crown portion 16 also provides a stable base on which the keg assembly 1 may rest if the keg assembly is inverted in use.

The crown portion 16 is generally formed by four handles 20, each of which has a curved shape with a centre of curvature that is coincident with the longitudinal axis of the chime 10 and forms an arc section of the overall crown portion 16. The crown portion 16 further comprises a set of four generally vertically extending struts or arms 17 via which the handles 20 are connected to the body portion 11 and the outer wall 13 of the top chime 10, with one of the arms 17 being provided between each adjacent pair of handles 20 such that each handle 20 extends between and is connected to the body portion 11 and the outer wall 13 by an adjacent pair of arms 17. Each arm 17 includes an inner wall 17*a* that is connected to the body portion 11 of the top chime 10, and an outer wall 17*b* arranged outboard of the inner wall 17*a* that is connected to the outer wall 13 of the top chime 10. The arms 17 are spaced apart from each other such that a gripping aperture is provided below each handle 20 in order to facilitate gripping of the top chime 10 by one or more of the handles 20.

The top chime 10 is injection moulded as a single, integrally formed component and in the present embodiment is formed of HDPE, although other materials may equally be used in other embodiments.

In the present embodiment, the top chime 10 is configured to be mounted to the keg 100 via engagement of the central portion 10 with a locking assembly 30. The locking assembly 30 includes a substantially planar U shaped element or collar 31 that is configured to be placed around the neck portion 104 of the keg 100 underneath a lower annular ring provided on the neck portion 104, and to be retained beneath the lower annular ring (as illustrated in FIGS. 4*b* and 5*b*). The locking assembly 30 further includes a locking element or collar insert 32 that is configured to be received in the open mouth of the collar 31 in order to form a closed ring surrounding the neck portion 104 of the keg 100. Once the locking assembly 30 has been assembled around the neck portion 104 of the keg 100, the top chime 10 may be screwed onto the locking assembly 30, with external thread formations provided around the outside of the locking assembly 30 being engaged by complimentary thread formations provided around the inside of the central aperture 12 through the body portion 11 to thereby secure the top chime 10 to the neck portion 104 of the keg 100.

When the top chime 10 is screwed onto the locking assembly 30, a latch formation provided on the collar insert 32 (not illustrated) becomes engaged with a corresponding recess provided in the body portion 11 of the top chime 10 in order to lock the top chime 10 with respect to the locking assembly 30. The latch formation may be moved axially inwardly (towards the longitudinal axis of the top chime 10) by pressing a lever element 33 in order to release the latch formation from the recess provided in the body portion 11 of the top chime 10 to thereby permit removal of the top chime 10 from the locking assembly 30 and the keg 100 after use.

When the top chime 10 has been mounted to the keg in the manner described above, the top chime 10 protects the shoulder portion 103, neck portion 104 and closure 105 of the keg 100. The handles 20 of the top chime 10 also provide convenient gripping points by which the keg may be manually handled and/or gripped by a machine, for example in a keg filling line. The crown portion 16 and handles 20 are designed such that the keg 100 with the top chime 10 mounted thereto may be handled by machines used in keg handling, cleaning and filling lines in a similar way to traditional metal kegs including an integral top chime with minimal modifications to the keg handling apparatus.

As illustrated in cross-section in FIGS. 5*a*, 5*b* and 6 and respectively from above and below in the partial views of FIGS. 7 and 8 (which each show a quarter segment of the crown portion 16 with the remaining parts of the top chime 10 omitted for clarity), each handle 20 is formed by a continuous handle element 21 that has a waveform profile with an approximately sinusoidal shape. The following description refers to a single one of the handles 20, but it will be appreciated that each of the handles 20 may include any or all of the features described below.

Figure 5A:
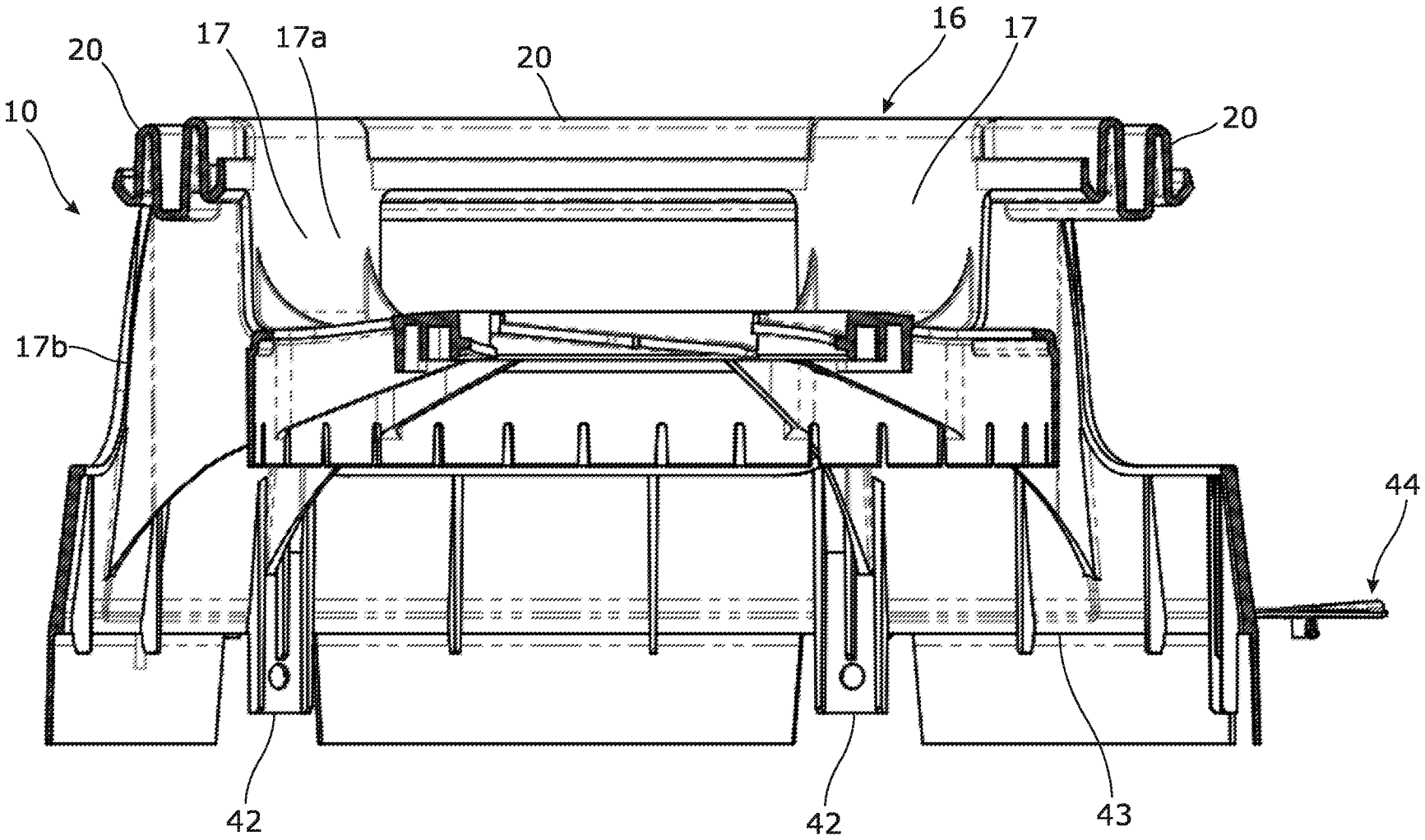
Figure 5B:
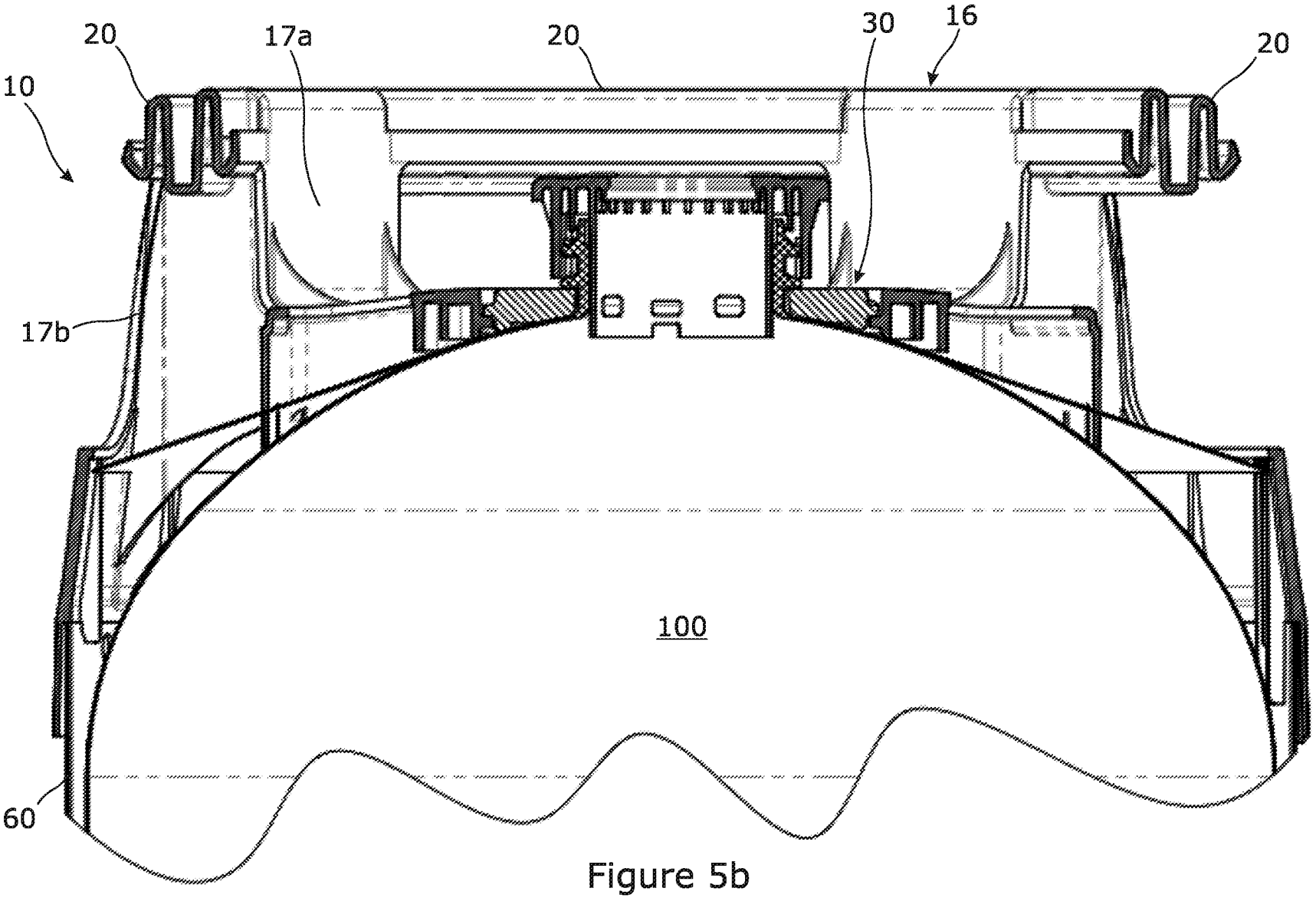
Figure 6:
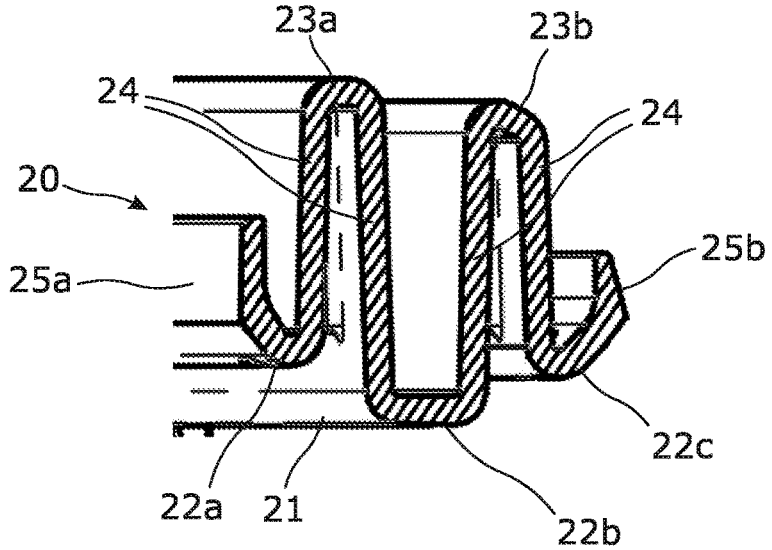
FIG. 6 illustrates a cross-section view through a handle of the top chime.
Figure 7:
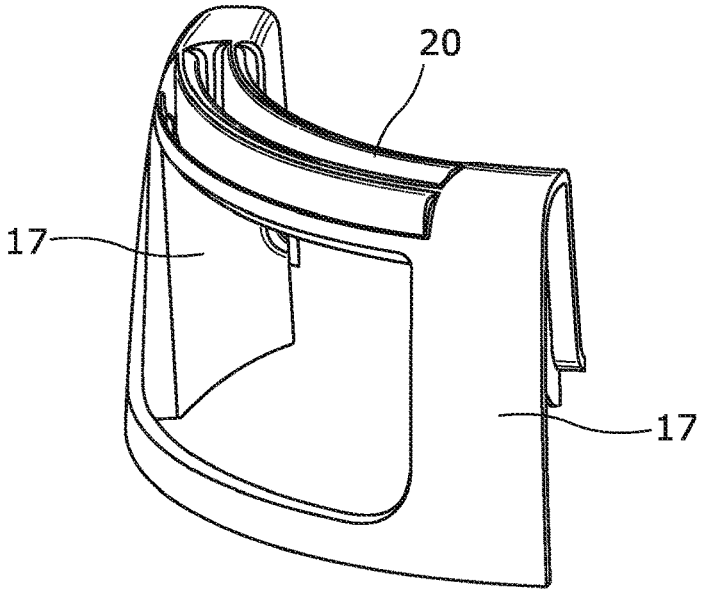
FIGS. 7 and 8 illustrate portions of the top chime.

The continuous handle element 21 includes a plurality of regions of inflection 22*a*, 22*b*, 22*c*, 23*a*, 23*b* when the handle 20 is viewed in cross-section along its length direction (as in FIGS. 5*a*, 5*b* and 6). The regions of inflection 22*a*, 22*b*, 22*c*, 23*a*, 23*b* include three lower regions of inflection 22*a*, 22*b*, 22*c* or troughs at the bottom of the handle 20 that together define a lower surface or base of the handle 20, and a pair of upper regions of inflection 23*a*, 23*b* or peaks at the top of the handle 20 that together define a top surface of the handle 20. The continuous handle element 21 alternates between lower and upper regions of inflection in a direction extending radially away from the longitudinal axis of the top chime 10.

Each region of inflection 22*a*, 22*b*, 22*c*, 23*a*, 23*b* is connected to one or more adjacent regions of inflection from the opposite surface of the handle 20 by one or more substantially vertical connecting walls 24, as illustrated in FIG. 6. For example, the inner-most lower region of inflection 22*a* is connected to the inner-most upper region of inflection 23*a* by a first connecting wall 24, the middle lower region of inflection 22*b* is connected to the inner-most and outer-most upper regions of inflection 23*a*, 23*b* by second and third connecting walls 24, and the outer-most lower region of inflection 22*c* is connected to the outer-most upper region of inflection 23*b* by a fourth connecting wall. The connecting walls 24 are each arranged substantially parallel to each other, but are slightly angled with respect to each other in order to facilitate demoulding of the handle 20.

The continuous handle element 21 further includes a pair of outer walls 25*a*, 25*b* that respectively extend outwardly from the inner-most and outer-most lower regions of inflection 22*a*, 22*c* and define side edges of the handle 20.

The inner-most lower region of inflection 22*a* has substantially continuously curved shape between the inwardly facing outer wall 25*a* and the first connecting wall 24. Similarly, the outer-most lower region of inflection 22*c* also has a substantially continuously curved shape. In contrast, the middle lower region of inflection 22*b* and the inner-most and outer-most upper regions of inflection 23*a*, 23*b* each include a substantially planar central portion that is joined to a pair of connecting walls via smoothly curving transition portions in order to increase the contact area of the handle 20.

The base and top surface of the handle 20 each have a generally smoothly curved convex shape when viewed in cross-section along the length of the handle 20 (as in FIGS. 5*a*, 5*b* and 6) due to the shapes and relative positions of the regions of inflection 22*a*, 22*b*, 22*c*, 23*a*, 23*b*. Since the base and the top surface of the handle 20 are each formed by a plurality of regions of inflection, the handle arrangement avoids any sharp edges on the major gripping surfaces and is therefore comfortable for manual handling. The overall outer shape of the handle 20 (as defined by the regions of inflection 22*a*, 22*b*, 22*c*, 23*a*, 23*b* and the outer walls 25*a*, 25*b*) is generally circular when the handle 20 is viewed in cross-section along its length, which results in a handle that is strong, convenient for gripping by keg handling apparatus, and comfortable for manual handling.

The regions of inflection 22*a*, 22*b*, 22*c*, 23*a*, 23*b*, connecting walls 24 and outer walls 25 each extend along the length of the handle 20 following a curved path between the arms 17 at either end of the handle 20, and are each substantially constant in shape along the length of the handle 20 such that the handle 20 has a substantially constant cross-sectional profile along its length.

Figure 8:
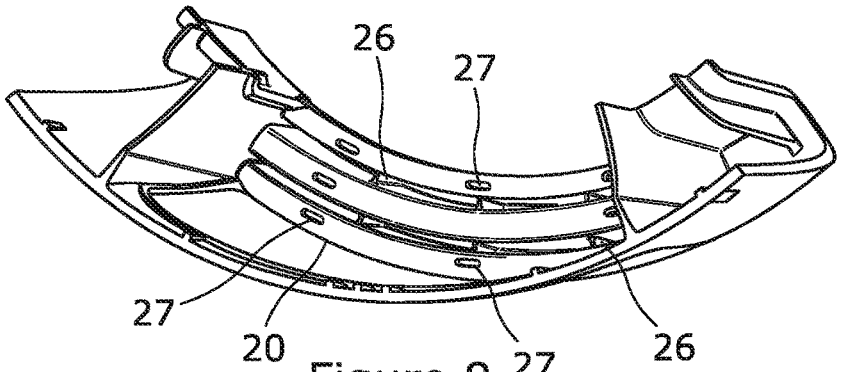

The handle 20 further comprises a plurality of reinforcing webs 26 that extend between and connect adjacent walls 24, 25 of the continuous handle element 21 in order to provide reinforcement to the handle 20, as illustrated in FIG. 8. The reinforcing webs 26 are also visible in FIGS. 4*a* and 4*b*, which illustrate cross-sections through the centre of the top chime 10 passing through four of the reinforcing webs 26.

The above-described handle construction results in a chime handle 20 that is simple, robust, stiff and lightweight, as well as being convenient and comfortable for manual handling and gripping by machine. The waveform profile of the handle 20 also results in an efficient use of material in the handle and therefore allows a reduction in the quantity of material required to form the handle 20, thereby reducing the cost and weight of the top chime 10.

Each of the lower regions of inflection 22*a*, 22*b*, 22*c* is provided with a plurality of through holes or drainage apertures 27 in order to allow any fluid that may collect within the handle 20 during use of the top chime 10 to drain out of the handle 20.

The top chime 10 is provided with a sleeve holder arrangement 40 that is configured to receive the upper end of the sleeve 60 and retain the sleeve 60 with respect to the top chime 10 when the sleeve 60 has been assembled together with the top chime 10, as illustrated in FIG. 1. The sleeve holder arrangement 40 comprises an annular groove 41 defined between the interior surface of the top chime outer wall 13 and a set of 6 struts or post elements 42 that are connected to the outer wall 13 and extend downwardly in a direction substantially parallel to the outer wall 13. The annular groove 41 terminates in a shoulder 43 provided around the interior of the annular wall 13 that is configured to be engaged by an upper end face of the sleeve 60 when the sleeve 60 has been assembled together with the top chime 10.

The sleeve 60 is configured to be retained with respect to the top chime 10 by engagement of a plurality of engagement structures 44 provided on the top chime 10 with a corresponding plurality of apertures 61 provided through the wall of the sleeve 60 at a location close to the top end of the sleeve 60. In particular, the outer wall 13 of the top chime 10 is provided with a set of 6 bosses or engagement elements 45 each provided on a flap 46 that is pivotably connected to the main body of the outer wall 13 by a living hinge at a location adjacent to (and radially outboard of) a respective one of the post elements 42. When the top end of the sleeve 60 has been inserted into the annular groove 41 of the sleeve holder arrangement 40 with the apertures 60 aligned with the engagement elements 45, for example by lowering a keg 100 with the top chime 10 mounted thereto into the sleeve 60, the flaps 46 may be pressed inwardly with respect to the top chime 10 and the sleeve 60 in order to push the engagement elements 45 into the apertures 61, as illustrated in FIG. 4*b*, to thereby secure the top chime 10 to the sleeve 60. When the flaps 46 have been fully depressed with respect to the top chime 10 and the sleeve 60 each of the engagement elements 45 also become engaged with a corresponding aperture 47 provided in a respective one of the post elements 42, with a small lip provided at the tip of each engagement element 45 acting to prevent accidental removal of the engagement elements 45 from the apertures 47, 61 provided in the post elements 42 and the sleeve 60.

The sleeve 60 may be formed, for example, of polyethylene terephthalate (PET) or polyethylene naphthalate (PEN), and may have a corrugated structure including an inner wall and an outer wall that are connected to each other by linking elements. In some cases the sleeve 60 may be formed from a flat sheet of material that has been looped onto itself, for example by cutting a flat sheet of stock material, bending the cut sheet into a cylindrical shape, and welding or bonding ends of the sheet together to form the cylindrical sleeve 60. The outer surface of the sleeve 60 may be used to display branding and/or information relating to the product contained within the keg 100, in which case the branding and/or other information may be printed on the sheet before the sheet has been bent into its final cylindrical shape. The apertures 61 that are engaged by the engagement elements 45 of the top chime 10 may similarly be punched or cut through the sheet material before the sheet has been bent into its final cylindrical shape.

The bottom chime 50 defines a socket that is configured to receive the base portion 101 of the keg 100 when the keg 100 is held within the keg protection assembly 2 as illustrated in FIG. 1. The bottom chime 50 may include a plurality or radially extending ribs (not illustrated in the figures) each having a profile that compliments at least a portion of the shape of the base portion 101 of the keg 100, with the top surfaces of the ribs defining the shape of the socket. The bottom chime 50 may also have an outer shape that is designed to cooperate with the top chime 10 in order to facilitate stacking of completed keg assemblies 1, for example with the base of a bottom chime 50 sitting within the recess defined by the crown portion 16 of a top chime 10 of an adjacent unit.

The bottom chime 50 is also provided with a sleeve holder arrangement in an outer wall 53 thereof that is configured to receive and retain a lower end of the sleeve 60 when the sleeve 60 has been assembled together with the bottom chime 50, as illustrated in FIG. 1. The sleeve holder arrangement of the bottom chime is generally similar to the sleeve holder arrangement 40 of the top chime 10 as described above, and so will not be described in detail. During assembly of the keg protection assembly 2, the sleeve 60 may be assembled together with the bottom chime 50 before the keg 100 (with the top chime 10 mounted thereto) is lowered into the sleeve 60 in order to mount the top chime 10 to the sleeve 60.

When the bottom chime 50, sleeve 60 and top chime 10 have been assembled together with the keg 100 to provide a keg assembly 1, as illustrated in FIG. 1, the keg 100 is preferably suspended by its neck portion 104 from the top chime 10. In this way the keg 100 may be held by the top chime 10, and the weight of the keg 100 may be transferred from the top chime 10 via the sleeve 60 to the bottom chime 50 which provides a stable base for the completed keg assembly 1. In this case the base portion 101 of the keg 100 may be spaced slightly apart from the socket of the bottom chime 50 in normal use of the keg (for example during filling and dispensing operations).

During use of the keg assembly 1, it is possible for the keg 100 to expand in both axial and radial directions as a result of increased internal pressure, for example due to high ambient temperatures and/or vibrations and impacts experienced by the keg 100. When increased internal pressure causes the keg 100 to expand in an axial direction it is possible for the base portion 101 of the keg to come into contact with the socket of the bottom chime 50, potentially limiting further expansion of the keg 100 and resulting in increased tension in the keg assembly 1. However, in accordance with an embodiment of the present invention, the couplings 45, 61 between the top chime 10 and the sleeve 60 are configured to allow the top chime 10 to move in an axially outward direction with respect to the sleeve 60 (and therefore away from the bottom chime 50) in order to accommodate an increase in the length of the keg 100.

In particular, the apertures 61 provided adjacent to the top end of the sleeve 60 (in which the engagement elements 45 of the top chime 10 are received) each take the form of a slot within which the engagement elements 45 are movable in an axial direction with respect to the sleeve 60 in order to permit outward movement of the top chime 10.

Figure 9A:
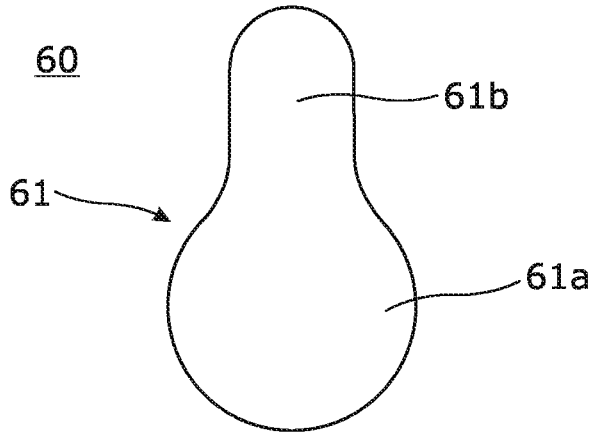
FIGS. 9*a* to 9*c* schematically illustrate a portion of the interface between the top chime and a sleeve of the keg assembly.
Figure 9B:
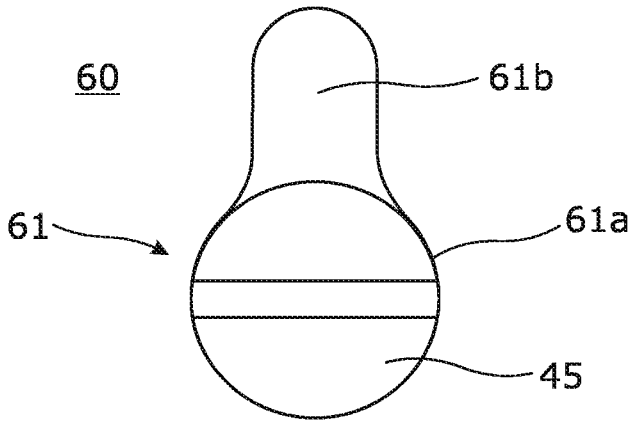

As schematically illustrated in FIG. 9*a*, each aperture 61 comprises a body portion 61*a* with a generally circular shape and an elongate expansion region 61*b* with a smaller width than the body portion 61*a* that extends outwardly from the body portion 61*a* in a direction towards the top end of the sleeve 60. When the top chime 10 is coupled to the sleeve 60 in the manner described above, the engagement elements 45 are initially each received in the body portion 61*a* of a respective one of the apertures 61, as schematically illustrated in FIG. 9*b*. The body portions 61*a* of the apertures 61 each have a size and shape that substantially corresponds to the size and shape of the engagement elements 45 such that the top chime 10 is securely held in its initial position.

As schematically illustrated in FIG. 9*b*, the expansion regions 61*b* each have a width that is smaller than the diameter of the engagement 45 elements such that the engagement elements 45 are initially prevented from moving out of the body portions 61*a* of the apertures 61 and into the expansion regions 61*b*. In this way then top chime 10 is initially prevented from moving outwardly from its initial position with respect to the sleeve 60.

Figure 9C:
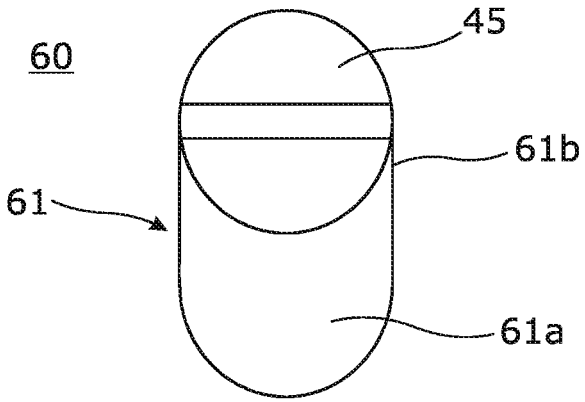

However, if increased internal pressure within the keg 100 results in the keg 100 expanding within the keg protection assembly 2 and pressing against the socket of the bottom chime 50, the keg 100 may begin to exert an upward force on the top chime 10. When the upward force exerted on the top chime 10 by the keg 100 exceeds a threshold, the engagement elements 45 of the top chime 10 may deform the apertures 61, as schematically illustrated in FIG. 9*c*, thereby enabling the top chime 10 to move axially outwardly with respect to the sleeve 60 (and therefore away from the bottom chime 50) as the engagement elements 45 move outwardly into the expansion regions 61*b*. In this way it is possible for the keg protection assembly 2 to accommodate increases in the length of the keg 100 without including a large amount of slack in the couplings 45, 61 between the top chime 10 and the sleeve 60 or providing a large clearance distance between the base portion 101 of the keg 100 and the socket of the bottom chime 50.

In some cases the expansion regions 61*b* may be configured to retain the engagement elements 45 in their outboard positions such that the top chime 10 remains in an outboard position with respect to the sleeve 60 after expansion of the keg protection assembly 2. However, in other embodiments the engagement elements 45 may be permitted to fall back into the body portions 61*a* of the apertures 61 such that the top chime 10 is permitted to return to its initial position with respect to the sleeve 60 after pressure within the keg 100 has decreased.

The coupling between the bottom chime 50 and the sleeve 60 may also be configured to allow the bottom chime 50 to move in an axially outward direction with respect to the sleeve 60 in a similar manner.

The above-described keg assembly 1 may be used as part of a two-way distribution system in which the keg assembly 1 is returned, cleaned and refilled after its first use. Alternatively the keg assembly 1 may be used as part of a one-way distribution system in which the keg assembly 1 is recycled after use, in which case the various components of the keg assembly 1 may be disassembled from each other to facilitate recycling. Alternatively the keg assembly 1 may be disassembled after use and one or more parts of the keg assembly 1 may be returned for repeated use while others are recycled. For example, in some cases the top and/or bottom chimes 10, 50 may be returned for repeated use while the keg 100 and closure 105 are recycled.

Many modifications may be made to the above examples without departing from the scope of the present invention as defined in the accompanying claims.

For example, in the above-described embodiment the top chime forms part of a keg protection assembly that further includes a bottom chime and a sleeve extending between the top and bottom chimes, in which the bottom chime protects a base portion of the keg and provides a stable base for the complete keg assembly, and the sleeve protects a body portion of the keg and connects the top chime to the bottom chime. However, in other embodiments the bottom chime may be omitted, in which case the sleeve may be provided with a closed base extending underneath the base portion of the keg. Alternatively, or in addition, the sleeve may also be omitted, in which case the top chime may be used as a stand-alone device for protecting the top portion of the keg and/or providing a convenient lifting point for the keg (optionally in conjunction with a further stand-alone bottom chime that is configured to be mounted directly to the lower end of the keg).

In embodiments in which the top chime is not configured to be connected to a sleeve the outer wall of the top chime may be omitted, in which case the top chime may include only a body portion for attachment to a neck portion of the keg and a crown portion including one or more handles connected to the body portion.

In the above-described embodiment the crown portion of the top chime has a circular shape and extends a significant distance above the body portion of the top chime and the top of the keg and closure to define a large central recess. However, in other embodiments the crown portion may have another shape, for example a square or octagonal shape, and may be provided at substantially the same height as the body portion of the top chime and the top of the keg and closure, in which case the arms that connect the handles to the body portion of the top chime may extend in a radially outward direction from the body portion instead of a substantially vertical direction. In addition, in some embodiments the crown portion may form the radially outer-most portion of the top chime, and may have an outside diameter that is greater than the diameter of the keg (and the sleeve, if present).

The above-described embodiment relates to a top chime including a plurality of handles each having a waveform profile including a plurality of regions of inflection. However, in other embodiments the waveform handle may alternatively or additionally be applied to a bottom chime, which may in some embodiments be configured to be mounted directly to a keg. In particular, the use of top and bottom chimes each including at least one of the handles may facilitate comfortable chest carrying of a keg to which the top and bottom chimes are mounted.

Other modifications and variations will also be apparent to the skilled person.

The invention claimed is:

1. A chime configured to be mounted to a keg, the chime comprising a handle that has a waveform profile when viewed in cross-section along a length direction of the handle, wherein the waveform profile defines at least one region of inflection forming at least part of a first surface of the handle, and at least one further region of inflection forming at least part of a second surface of the handle.

2. A chime according to claim 1, wherein the first surface is a bottom surface of the handle and the second surface is a top surface of the handle when the chime is in its normal orientation for use.

3. A chime according to claim 1, wherein at least one of the first and second surfaces of the handle is convexly curved when the handle is viewed in cross-section along its length direction.

4. A chime according to claim 1, wherein the waveform profile defines a plurality of regions of inflection that together form at least part of the first surface of the handle.

5. A chime according to claim 1, wherein the waveform profile defines a plurality of regions of inflection that together form at least part of the second surface of the handle.

6. A chime according to claim 1, wherein the handle comprises one or more walls forming a body of the handle.

7. A chime according to claim 6, wherein the handle comprises at least one connecting wall that extends between and connects a region of inflection forming at least part of the first surface of the handle and a region of inflection forming at least part of the second surface of the handle.

8. A chime according to claim 6, wherein the handle comprises at least one outer wall that extends outwardly from one of the regions of inflection to define an outer edge of the handle.

9. A chime according to claim 6, wherein the handle comprises at least one reinforcing web that extends between and connects an adjacent pair of the walls.

10. A chime according to claim 1, wherein at least one of the regions of inflection comprises a substantially planar central portion.

11. A chime according to claim 1, wherein at least one of the regions of inflection has a continuously curved shape.

12. A chime according to claim 1, wherein the waveform profile of the handle generally takes the form of a sine wave.

13. A chime according to claim 1, wherein the handle has a cross-sectional profile that is at least substantially constant along at least a majority of the length of the handle.

14. A chime according to claim 1, wherein the handle has a generally circular outer shape when viewed in cross-section along its length direction.

15. A chime according to claim 1, comprising at least one drainage aperture that is configured to allow fluid inside the handle to drain to the exterior of the handle.

16. A chime according to claim 1, wherein the handle extends between a pair of arms via which the handle is connected to a body portion of the chime.

17. A chime according to claim 1, wherein the handle has a curved shape along its length direction.

18. A chime according to claim 1, wherein the handle forms part of an outer crown portion of the chime.

19. A chime according to claim 1, wherein the chime is a top chime.

20. A keg assembly comprising a keg and at least one chime according to claim 1 mounted to the keg.

* * * * *